US007427705B2

(12) United States Patent
Rubens

(10) Patent No.: US 7,427,705 B2
(45) Date of Patent: Sep. 23, 2008

(54) GUITAR PICK RECORDER AND PLAYBACK DEVICE

(76) Inventor: Richard Rubens, 1921 Hughes Dr., Concord, CA (US) 94520-3957

( * ) Notice: Subject to any disclaimer, the term of this patent is extended or adjusted under 35 U.S.C. 154(b) by 107 days.

(21) Appl. No.: 11/458,056

(22) Filed: Jul. 17, 2006

(65) Prior Publication Data

US 2008/0022837 A1 Jan. 31, 2008

(51) Int. Cl.
*G10D 3/16* (2006.01)

(52) U.S. Cl. ..... 84/320; 84/322; 84/723

(58) Field of Classification Search ..... None
See application file for complete search history.

(56) References Cited

U.S. PATENT DOCUMENTS 4,554,919 A * 11/1985 Hubert ..... 606/234
5,568,792 A * 10/1996 Lynch ..... 119/713
5,725,409 A * 3/1998 Brunton ..... 446/2
6,421,305 B1 * 7/2002 Gioscia et al. ..... 369/30.06
6,652,346 B1 * 11/2003 Arnold, III ..... 446/81
7,050,573 B2 * 5/2006 Okazaki et al. ..... 379/373.02
2001/0011495 A1 * 8/2001 Song ..... 84/600
2001/0039869 A1 * 11/2001 Oren-Chazon ..... 84/1
2006/0064185 A1 * 3/2006 Yeh ..... 700/94
2006/0153344 A1 * 7/2006 Lee ..... 379/67.1

* cited by examiner

*Primary Examiner*—Marlon T Fletcher
(74) *Attorney, Agent, or Firm*—John Nielsen; Randick O'Dea & Tooliatos, LLP

(57) ABSTRACT

The invention disclosed herein comprises a guitar pick with a built-in recorder and playback device. The invention allows guitarists to record an audio sample into the recorder, then play it back directly through an amplified guitar or microphone.

11 Claims, 2 Drawing Sheets

GUITAR PICK RECORDER AND PLAYBACK DEVICE

I. BACKGROUND OF THE INVENTION

A. Field of the Invention

The invention disclosed herein falls into the field of guitar picks and miniature digital recorders and playback devices.

B. Prior Art

There are several guitar picks and miniature digital voice recorders and playback devices existing in prior art. Existing guitar picks include an extensive range of shapes, sizes, and materials used. Guitar picks are generally constructed of a solid material (i.e. plastic, marble, metal).

The prior art for miniature digital recorders and playback devices ranges from high-end miniature digital recorders that hold significant memory, to novelty items such as key chains that hold between 10 to 20 seconds of record time. Some examples in the prior art include a miniature mock cellular phone, and miniature microphone.

There also exists in the art recording apparatus located within the guitar. For example, the Eagen device (U.S. Pat. No. 5,837,912) discloses an apparatus and method for recording musical sounds generated by a guitar, using a mini-disc recorder unit located in and forming a portion of the envelope or housing of the guitar. The device purports to convert the analog output from the guitar into a digital recording for playback us by the user for generating musical sounds to a listener. Among the many differences between the Eagen device and the invention disclosed herein, the Eagen device is not part of the user's guitar pick, and does not allow the user to playback sounds recorded by the user into the user's sound system during the user's performance.

C. Problems in the Prior Art

The problems and shortcomings of the prior art is that guitar picks and miniature digital recorders have limited functionality by themselves. For example, guitar picks have a limited use made for picking and strumming guitar strings (not to record an audio sample). Record and playback devices have a limited use for recording and playing audio recordings (not for picking guitar strings). The prior art does not allow a guitarist to both use a pick to play the guitar and easily access a recording and playback device. As such, there is a need in the art for a device that allows the user to perform both functions simultaneously and conveniently.

II.SUMMARY OF THE INVENTION

A. Short Description of the Invention

The invention disclosed herein comprises a guitar pick with a built-in recorder and playback device. The invention allows guitarists to record an audio sample into the recorder, then play it back directly through an amplified guitar or microphone. The user decides what he or she wants to record, and when to play back. During playback, the playback device can be faced towards the guitar pick-up while muting the strings, or through a microphone. The audio sample can then heard through the corresponding guitar amplifier or PA system.

B. Objects and Advantages of the Invention

The advantages of the invention over the prior art relate mainly to practical functionality. The invention allows the user to consolidate physical tasks and reduce the number of steps in order for a guitarist to record and playback with very little effect on his or her playing style. Without the invention, one would have to go through the following steps in order to record and playback an audio sample through the guitar's pick-up:

Put down the guitar pick, or tuck pick under fingers.

Separately grab a miniature digital recorder, record and/or play an audio sample through the guitar pick-up or microphone, and hear through the amplifier.

Put down the miniature digital recorder.

Pick up the guitar pick again, or re-grasp pick that was tucked away, and resume normal playing.

User may be forced to repeat the above process each time.

This invention solves this problem by consolidating these tasks into one device, allowing the user to eliminate the above steps. The invention allows the user to record and play audio samples while during the activity of playing guitar. The invention will work with any amplified guitar or microphone. The invention can be used for non-musical playback purposes as well.

The user can record an audio sample on the device and play it back directly through the guitar's pick-up or any amplified guitar or microphone. The user may record the desired sounds, then playback the audio sample through the guitar's pick-up (usually while muting the strings). When using the recording and playback feature, it is recommended that the fore finger and thumb hold the device, while the middle and ring finger press and release the record and play buttons. During playback, the built-in miniature speaker is simply faced towards the guitar pick-up or microphone. The audio sample is then heard through the corresponding guitar amplifier or PA system.

In a preferred embodiment, the invention comprises a custom molded one-piece plastic guitar pick with battery powered built-in miniature digital recorder, speaker, and condenser microphone. The device is similar in size to standard guitar picks, but thicker and with a tapered design to allow for internal batteries, electronics, and speaker. The device is ergonomically designed so guitarists can easily press and release the record and play buttons during muting and/or playing guitar. The digital memory holds as much as possible, but preferably at least 10 to 20 seconds recording time. The device can be made of strong yet slightly flexible plastic so that the tip won't break off after extensive use. The batteries can lay flat inside the device with access through a small door at the back.

III. BRIEF DESCRIPTION OF THE DRAWINGS

IV. DETAILED DESCRIPTION OF THE DRAWINGS

Figure 1:
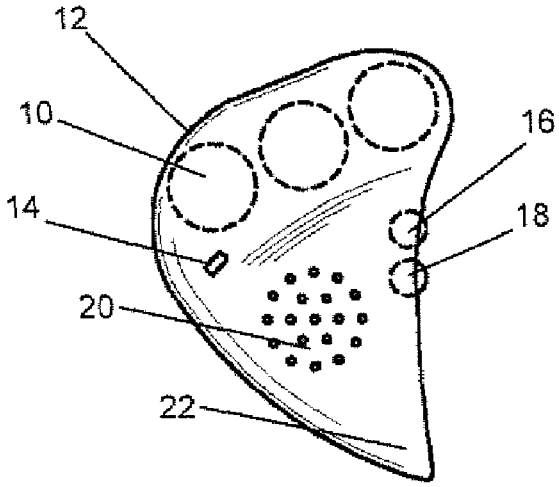
FIG. 1 is a front view of an embodiment of the invention disclosed herein.

FIG. 1 illustrates a front view of an embodiment of the guitar pick with recording and playback abilities. One or more batteries are shown located in the upper section of the housing. Preferably, the batteries 10 will be of generally flat configuration. This will allow the device to assume the general shape of a guitar pick. Also shown is an opening in the housing 12 that provides for a microphone inlet 14. When the user activates the Record button 16, external sounds will be recorded on the memory chip, which is also housed in the device. The memory chip may have the ability to record analog and/or digital information. The user may also utilize the Play function by activating the Play button 18 located on the pick. Activating the Play function will cause the device to broadcast the sounds previously recorded on the memory chip. The relative locations of the Play button 18 and the Record button 16 are interchangeable. Small openings 20 are shown in the housing that facilitate the broadcast of sound from the internal speaker. The tip of the device 22, as well as the device as a whole, is sized and shaped so as to facilitate its use as a conventional guitar pick.

Figure 2:
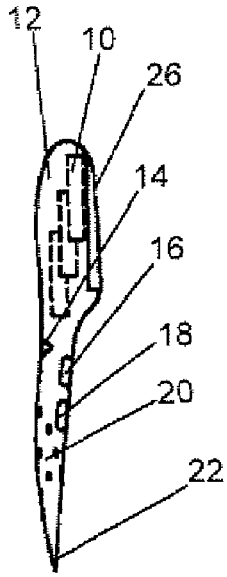
FIG. 2 is a side section view of an embodiment of the invention disclosed herein.

FIG. 2 is a side section view of an embodiment of the invention. The batteries 10 are shown in the upper section of the device. However, the specific location of the batteries 10, as well as all of the internal components, are thought to be the preferred embodiment, but are not critical to the functioning of the invention and should not act as a limitation of the invention. The lid 26 to the battery access compartment is shown, and is preferably a sealable opening. This lid access 26 allows the user to install and replace batteries as needed.

Also shown is the opening in the housing for the microphone inlet 14. The Record 16 and Play 18 activation elements are shown. It is intended that these activation elements be easily accessible to the user.

Figure 3:
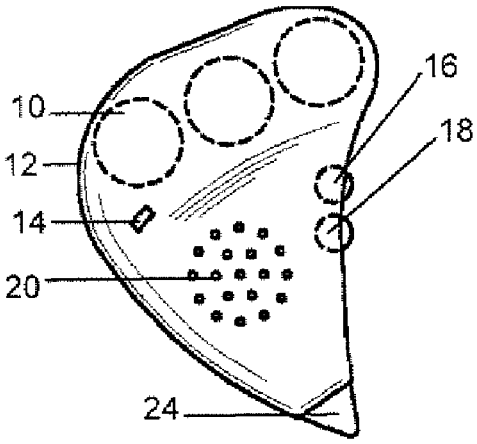
FIG. 3 is a view of an embodiment of the invention disclosed herein.

FIG. 3 illustrates a front view of an embodiment of the guitar pick with recording and playback abilities. This figure is similar to FIG. 1 in that it illustrates the batteries 10, the Play 16 and Record 18 buttons, the microphone inlet 14, and the holes in the housing 20 for the speaker 28. This figure however shows an alternate embodiment wherein the tip of the pick comprises a separate, conventional guitar pick 24 that has been combined with the invention herein. The second pick 24 can be attached to the housing 12 in a variety of ways, including but not limited to sliding it into one or more slots or notches in the housing 12. One of the benefits to this embodiment is that the user is provided with the feel of a standard, conventional guitar pick while the pick makes contact with the strings of the guitar. Furthermore, if the tip 24 is broken, or if a different 'feel' is desired, the second pick 24 can be quickly and easily replaced.

Figure 4:
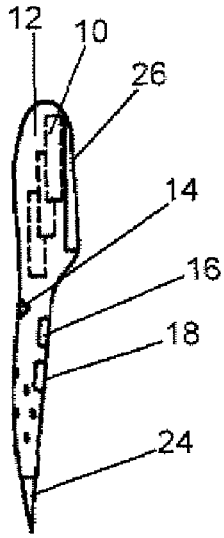
FIG. 4 is a side section view of an embodiment of the invention disclosed herein.

FIG. 4 is a side view of the embodiment illustrated in FIG. 3 and described herein. This figure is similar to FIG. 2 in that it illustrates the batteries 10, the Play 16 and Record 18 buttons, the microphone inlet 14, and the holes in the housing 20 for the speaker 28. This figure however shows the alternate embodiment shown in FIG. 3 and described herein, where the tip of the pick comprises a separate, conventional guitar pick 24 that has been combined with the invention herein. The second pick 24 can be attached to the housing 12 in a variety of ways, including but not limited to sliding it into one or more slots or notches in the housing 12. One of the benefits to this embodiment is that the user is provided with the feel of a standard, conventional guitar pick while the pick makes contact with the strings of the guitar. Furthermore, if the tip 24 is broken, or if a different 'feel' is desired, the second pick 24 can be quickly and easily replaced.

Figure 5:
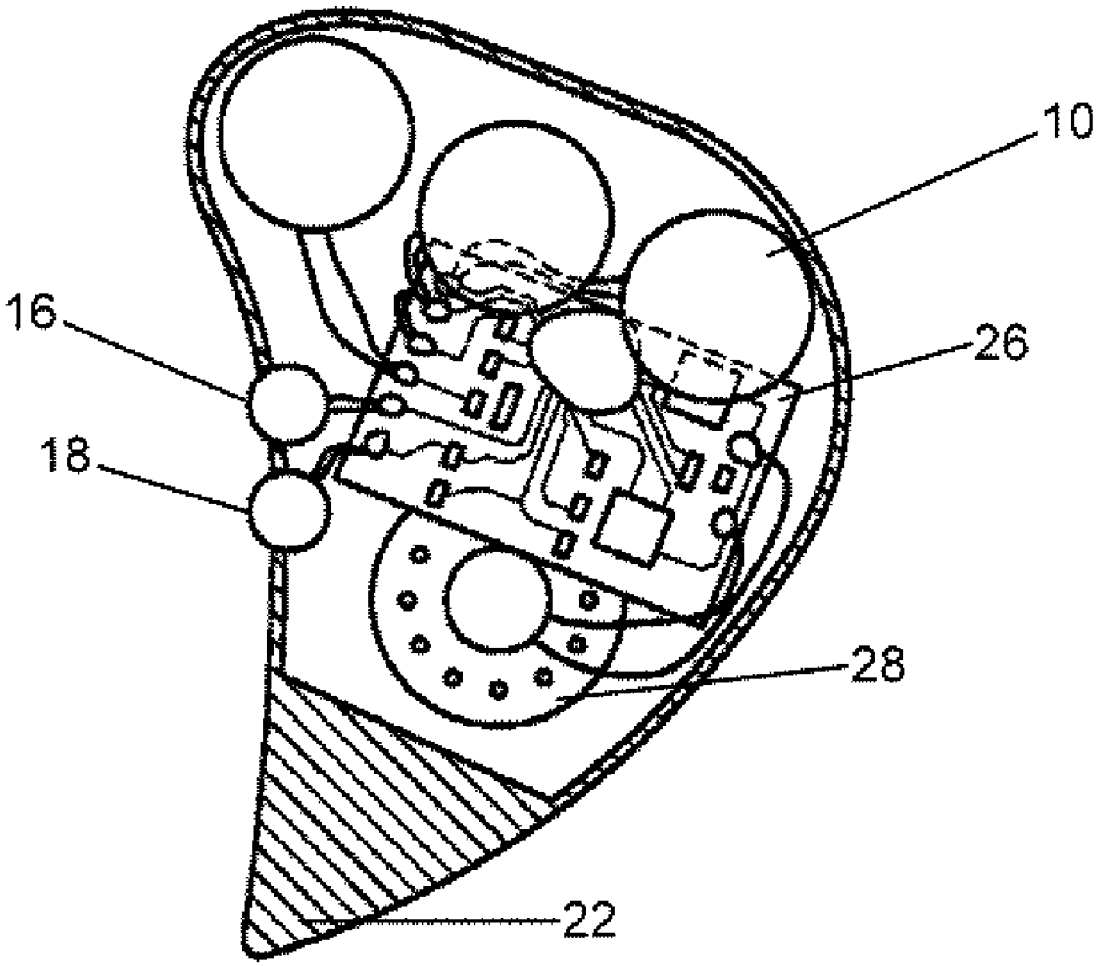
FIG. 5 is a front view of the internal components of an embodiment of the invention disclosed herein.

FIG. 5 is a front view of the internal components of an embodiment of the invention disclosed herein This figure illustrates several of the components previously described, such as the batteries 10, and the Play button 18 and the Record button 16. Additionally, this figure shows a conventional circuit board 26 that comprises transistors, memory chip(s), and connections that may be needed for the invention to function. Also shown is the speaker 28 unit that resides within the housing, and is attached to the circuit board.

What is claimed is:

1. An apparatus for recording and playback of audible sounds into an electric guitar pickup device comprising:

a. a housing comprising the generally size and shape of a guitar pick;

b. a means to record, and store and playback audio sounds, wherein said means are located within the housing;

c. a means to activate the recording and playback means such that the recorded audio sounds are capable of being broadcasted on a pickup device of an electric guitar; and d. a power source located within the housing.

2. The apparatus of claim 1, wherein the recording and playback means utilize digital signals.

3. The apparatus of claim 1, wherein the means to activate the recording and playback means comprise buttons located on the housing.

4. The apparatus of claim 1, wherein the power source located within the housing comprises one or more batteries.

5. The apparatus of claim 1, wherein the recording means further comprise a microphone located within the housing.

6. The apparatus of claim 1, wherein the recording means further comprise a memory chip located within the housing.

7. The apparatus of claim 1, wherein the playback means further comprise a speaker.

8. The apparatus of claim 1, wherein a portion of the housing comprises a conventional guitar pick.

9. The apparatus of claim 1, wherein a portion of the housing comprises one or more notches capable of retaining a conventional guitar pick.

10. The apparatus of claim 1, wherein a portion of the housing. comprises one or more slots capable of retaining a conventional guitar pick

11. A method of broadcasting audio sound through a pickup system on an electric guitar, comprising:

a. recording audio sounds on a device capable of recording and broadcasting sounds, wherein the device comprises a housing that has generally the size and shape of a guitar pick; and b. broadcasting the sounds from the device into a pickup system of an electric guitar.

* * * * *